US008577254B2

(12) United States Patent
Katogi

(10) Patent No.: US 8,577,254 B2
(45) Date of Patent: Nov. 5, 2013

(54) SLIDE RAIL AND IMAGE FORMING APPARATUS WITH THE SAME

(75) Inventor: Syuichi Katogi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 216 days.

(21) Appl. No.: 13/151,686

(22) Filed: Jun. 2, 2011

(65) Prior Publication Data

US 2011/0303114 A1 Dec. 15, 2011

(30) Foreign Application Priority Data

Jun. 10, 2010 (JP) ..... 2010-132800

(51) Int. Cl.
*G03G 15/00* (2006.01)

(52) U.S. Cl.
USPC ..... 399/110

(58) Field of Classification Search
USPC ..... 104/107; 384/7, 20, 21, 23; 312/334.1, 312/334.7, 334.8, 334.14, 334.27, 334.34, 312/334.44, 330.1, 29, 334.9, 333; 399/110, 107, 411
See application file for complete search history.

(56) References Cited

U.S. PATENT DOCUMENTS

| | | | | |
|---|---|---|---|---|
| 3,365,261 | A * | 1/1968 | Gutner | 312/334.34 |
| 3,702,717 | A * | 11/1972 | Gutner | 84/23 |
| 2005/0013629 | A1 | 1/2005 | Ito et al. | |
| 2007/0159038 | A1 * | 7/2007 | Huang | 312/333 |

FOREIGN PATENT DOCUMENTS

| | | | | |
|---|---|---|---|---|
| JP | 60-133222 | U | | 9/1985 |
| JP | 63-253955 | A | | 10/1988 |
| JP | 64-019953 | U | | 1/1989 |
| JP | 7-223471 | A | | 8/1995 |
| JP | 08320019 | A | * | 12/1996 |
| JP | 2002-017486 | A | | 1/2002 |
| JP | 2005-037677 | A | | 2/2005 |
| JP | 2010-100077 | A | | 5/2010 |

OTHER PUBLICATIONS

Machine Translation of Osawa, JP 08-320019.*
Office Action (Noitifcation of Reason(s) for Refusal) dated May 8, 2012, issued in corresponding Japanese Patent Application No. 2010-132800, and an English Translation thereof. (6 pages).

* cited by examiner

*Primary Examiner* — David Gray
*Assistant Examiner* — Sevan A Aydin
(74) *Attorney, Agent, or Firm* — Buchanan Ingersoll & Rooney PC

(57) ABSTRACT

A slide rail includes an outer rail and an inner rail. The inner rail includes a top face portion, main-portion side walls, outer deck portions, and end-portion side walls. The outer rail includes a bottom wall and a storage portion. The main-portion side walls and the end-portion side walls are both provided adjacently on both sides of the top face portion in a width direction thereof, and bent toward outer rail. The main-portion side walls are provided in a portion other than one end portion in the longitudinal direction. The end-portion side walls are provided in the one end portion. Each outer deck portion extends outward in the width direction to be continuous to an edge of each main-portion side wall opposite the top face portion. The storage portions are provided adjacently on both sides of the bottom wall in the width direction and bent toward the inner rail to cover the outer edge portions.

10 Claims, 8 Drawing Sheets

SLIDE RAIL AND IMAGE FORMING APPARATUS WITH THE SAME

CROSS-REFERENCE TO RELATED APPLICATIONS

This application is based upon and claims the benefit of priority from the prior Japanese Patent Application No. 2010-132800, filed on Jun. 10, 2010, the entire contents of which are incorporated herein by reference.

BACKGROUND OF THE INVENTION

1. Field of the Invention

The present invention relates to a slide rail comprising a first member and a second member that are assembled to be slidable with respect to each other. More particularly, the present invention relates to a slide rail suitable for slidably connecting a main body and an image forming unit in an image forming apparatus, and the image forming apparatus.

2. Description of Related Art

In various types of apparatuses, heretofore, one or some of components thereof are mounted to be slidable with respect to a main body of each apparatus. This configuration is intended for example to facilitate replacement and maintenance of those components. In this case, the components are combined into a unit which can be pulled out from the main body. This unitized component is set to be slidably moved between a position for actual operation inside the main body and the other position for maintenance outside the main body. For this end, a slide rail is used. Such a configuration is applied to for example some image forming apparatus (JP2005-37677A).

For storage containers or the like, it is necessary to take a stored position and a pull-out position from the viewpoint of an intended purpose thereof besides maintenance. In such a component also, a container part is slidable with respect to a housing part and thus a slide rail is used (JP2002-17486A). Moreover, differently from the stored position and the pull-out position, there is also a component needing its positional adjustment to suit to the size of each user's body. One example thereof is a car seat using a slide rail (JP2010-100077A).

A slide rail usually consists of a long outer rail and a long inner rail slidably combined into one. The outer rail and the inner rail are fixed to different ones of two members to thereby assemble the two members slidably with respect to each other. FIGS. 10 to 12 show the shape of one end of an inner rail of a typical conventional slide rail. Specifically, FIGS. 10 and 11 are perspective views, showing each other's reverse sides and FIG. 12 is a plan view. An inner rail 70 shown in those figures is made from a long flat plate into such an illustrated shape. In this inner rail 70, an end portion 71 and a main portion 72 are different in shape.

The end portion 71 of the inner rail 70 consists of a part of a flat portion 73 and end-portion side walls 74 arranged on both sides of the flat portion 73. Each of the end-portion side walls 74 is made by bending a part of the original flat plate almost perpendicularly to and on the same side of the flat portion 73. On the other hand, the main portion 72 of the inner rail 70 also consists of the other part of the flat portion 73 and main-portion side walls 75 arranged on both sides of the flat portion 73. The flat portion 73 is continuous over the end portion 71 and the main portion 72. As with the end-portion side walls 74, each of the main-portion side walls 75 is also made by bending a part of the original flat plate on the same side of the flat portion 73. However, each main-portion side walls 75 is further bent at two different positions above the bent portion from the flat portion 73. Accordingly, each main-portion side wall 75 has a crank-like shape in cross-section defined by a lower wall portion 76, a middle step portion 77, and an upper wall portion 78.

Herein, relative to the flat portion 73, a protruding height H of each end-portion side wall 74 is larger than a protruding height H2 of each lower wall portion 76. Further, on each side of the flat portion 73, a slit 79 is formed between the end-portion side wall 74 and the main-portion side wall 75, so that the slit 79 completely separates the end-portion side wall 74 and the main-portion side wall 75. The slit 79 also extends slightly into the flat portion 73. This inner rail 70 is slidably inserted in an outer rail having a little larger cross-sectional shape than and a long length as with the inner rail 70, thus completing a slide rail. The outer rail is provided with a part that does not interfere with the main-portion side walls 75 but does interfere with the end-portion side walls 74. By contact of such part with the end-portion side walls 74, a slidable range of the inner rail 70 is limited. This allows the two members to slide but prevents from coming apart.

However, the aforementioned conventional slide rail has the following problems. To be concrete, the end-portion side walls 74 are low in strength, even though the end-portion side walls 74 have a function of limiting the slidable range by contacting a part of the outer rail as mentioned above. Accordingly, the end-portion side walls 74 bump on the relevant part of the outer rail with a considerably high frequency, resulting in deformation of the end-portion side walls 74. Thus, the end-portion side walls 74 lose the function of limiting the slidable range. The inner rail 70 is therefore liable to come off the outer rail. In other words, the conventional slide rail is poor in durability. Especially, this tendency is extreme in a case where a movable one of the two components is heavy. Also, there is a type using a ball bearing but it needs a large number of components, leading to a complex structure.

SUMMARY OF THE INVENTION

One aspect of the invention provides a slide rail comprising an outer rail and an inner rail, the inner rail being placed in the outer rail to be slidable in a longitudinal direction of the slide rail, wherein the inner rail comprises: a top face portion located in a center of the inner rail in a width direction of the inner rail, the top face portion being continuous in the longitudinal direction; main-portion side walls provided adjacently on both sides of the top face portion in a width direction in the width direction, excepting one end portion in the longitudinal direction, each main-portion side wall being bent toward the outer rail; outer deck portions each extending outward in the width direction to be continuous to an edge of each main-portion side wall opposite the top face portion; and end-portion side walls provided adjacently on both sides of top face portion in the one end portion in the width direction, each end-portion side wall being bent toward the outer rail, a size in a height direction of each end-portion side wall is larger than a size in a height direction of each main-portion side wall, the end-portion side walls are continuous to the main-portion side walls respectively, and the outer rail comprises: a bottom wall located in a center of the outer rail in a width direction of the outer rail, the bottom wall being continuous in the longitudinal direction; and storage portions provided adjacently on both sides of the bottom wall in the width direction, and each storage portion being bent toward the inner rail to cover the outer deck portions of the inner rail.

In this slide rail, the side walls of the end portion of the inner rail are continuous to the main-portion side walls of the portion other than the end portion. Specifically, the end portion and the other portion are also continuous in not only the top face portion but also the side walls (the end-portion side wall and the main-portion side wall).

The image forming apparatus according to the present invention includes the main body, the image forming unit slidable out of the main body, and the slide rail for attaching the image forming unit in the main body in a slidable manner. One of the inner rail and the outer rail is fixed to the main body and the other is fixed to the image forming unit.

DESCRIPTION OF EMBODIMENTS

A detailed description of a preferred embodiment of the present invention will now be given referring to the accompanying drawings. In this embodiment, the present invention is applied to an image forming apparatus in which a photo conductor and its peripheral devices are combined into one unit, which can be pulled out from a main body. A slide rail of the present invention is adopted in a pull-out mechanism of the unit.

Figure 1:
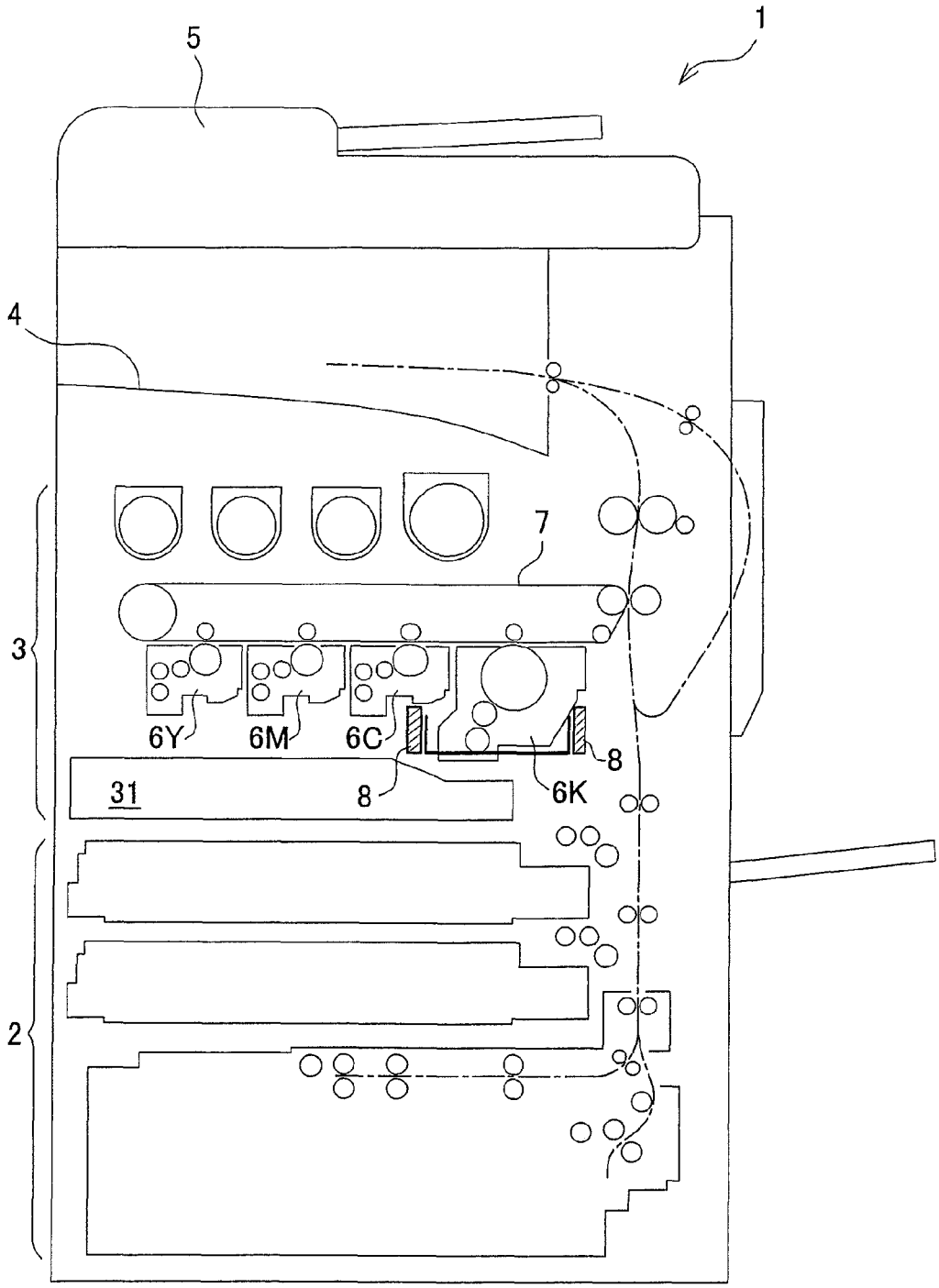
FIG. 1 is a cross-sectional view of an image forming apparatus in an embodiment.

FIG. 1 shows an entire structure of the image forming apparatus in the embodiment. The image forming apparatus in FIG. 1 includes a sheet feeding section 2, an image forming section 3, a sheet discharging section 4, a reading section 5, and others. The image forming section 3 includes four image forming parts 6Y, 6M, 6C, and 6K, an intermediate transfer belt 7, and an exposing device 31. Each image forming part 6Y, 6M, 6C, and 6K includes a photo conductor and a developing device to form a toner image in a relevant color. Based on image data read from an original document by the reading section 5, a toner image is formed in four colors, Yellow (Y), Magenta (M), Cyan (C), and Black (B) by the image forming parts 6Y, 6M, 6C, and 6K. The toner images are superimposed on the transfer belt 7. Further, a superimposed full-color toner image is transferred onto a sheet supplied from the sheet feeding section 2. The sheet is then discharged onto the sheet discharging section 4 through a fixing operation.

Figure 2:
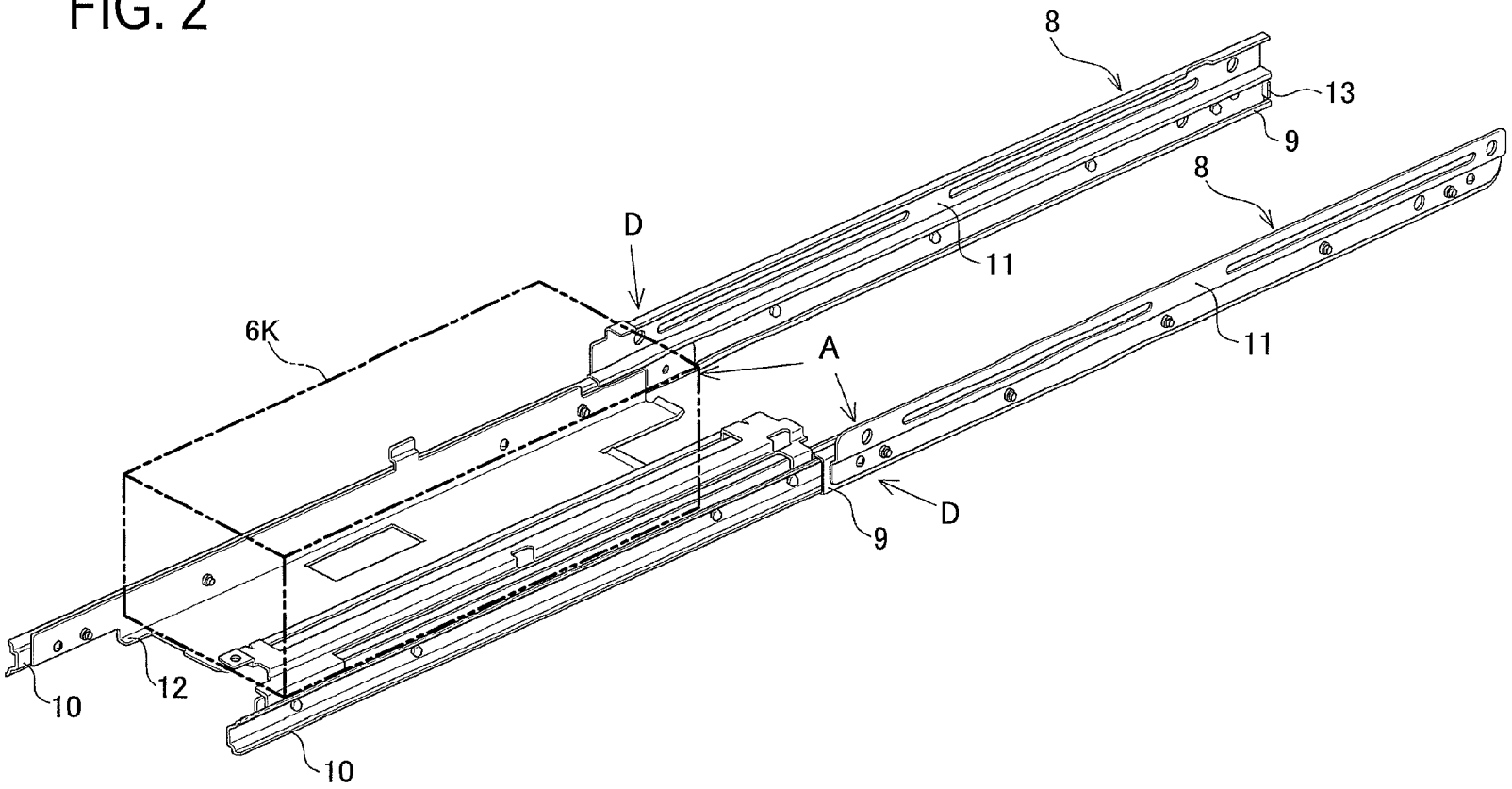
FIG. 2 is a perspective view of a pull-out part of an image-forming unit in the image forming apparatus in the embodiment.

Here, the image forming part 6K for black color (K) is configured as a unit that can be pulled out from the apparatus main body. Hereinafter, the image forming part 6K is referred to as an image forming unit 6K. A pull-out structure of the image forming unit 6K is explained referring to FIG. 2. The image forming apparatus 1 includes, as shown in FIG. 2, two long slide rails 8 arranged in parallel. Each of the two slide rails 8 consists of an outer rail 9 and an inner rail 10. The outer rail 9 and the inner rail 10 are both designed to be long and slidable relative to each other in a longitudinal direction.

Each outer rail 9 is fixed to the main body of the image forming apparatus 1 through an attachment stay 11. Each inner rail 10 is attached with a unit tray 12. This tray 12 is attached to bridge the inner rails 10 of the slide rails 8. Accordingly, the inner rails 10 are allowed to slide together with respect to the main body of the image forming apparatus 1. The unit tray 12 is a component for mounting the image forming unit 6K. In FIG. 2, respective major parts of the inner rails 10 are pulled out from the outer rails 9. This shows a situation of the slide rails 8 in which the image forming unit 6K is pulled out from the main body, that is, a situation for various works of maintenance such as replacement of the image forming unit 6K.

Figure 3:
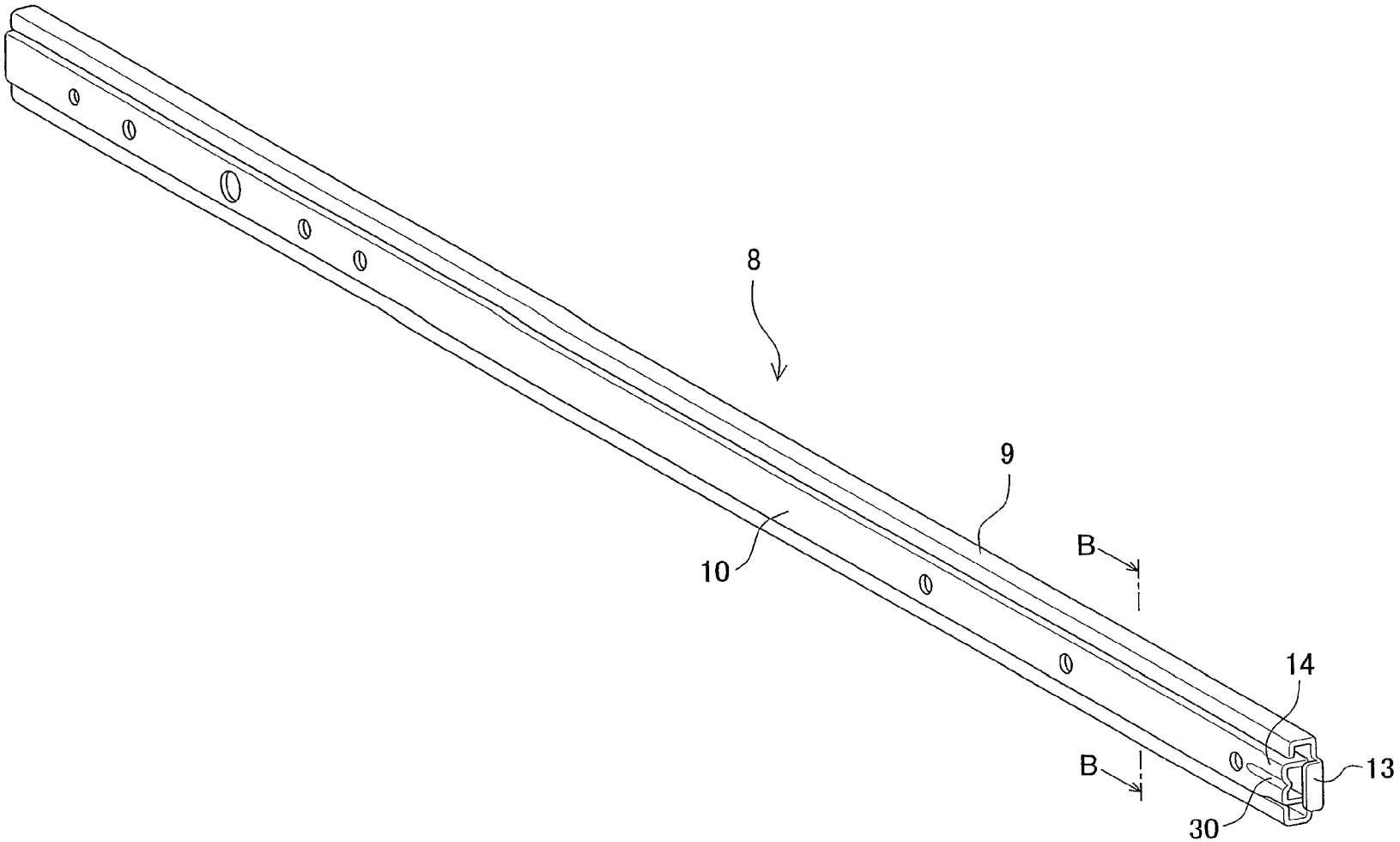
FIG. 3 is a perspective view of a slide rail used in the image forming apparatus in the embodiment.

FIG. 3 shows one of the slide rails 8 alone. In the slide rail 8 shown in FIG. 3, a major part of the inner rail 10 is placed in the outer rail 9. From the viewpoint of the image forming apparatus 1, this state corresponds to a state in which the image forming unit 6K is stored in the main body, i.e., in an operating state that enables image formation. In FIG. 3, a first stopper 13 is provided at a lower right end of the outer rail 9. The first stopper 13 serves to define one limit of a slidable range of the inner rail 10 and prevent the inner rail 10 from protruding from the outer rail 9 to the lower right in FIG. 3. The first stopper 13 is located at an upper right end of the outer rail 9 in FIG. 2 and, in the image forming apparatus 1, is positioned at a back side in a depth direction of the apparatus main body. In FIG. 3, further, an end portion 14 which is one end of the inner rail 10 appears adjacent to the first stopper 13. The end portion 14 is located around a position indicated by an arrow A in FIG. 2. Limitation to the other limit of the slidable range will be mentioned later.

Figure 4:
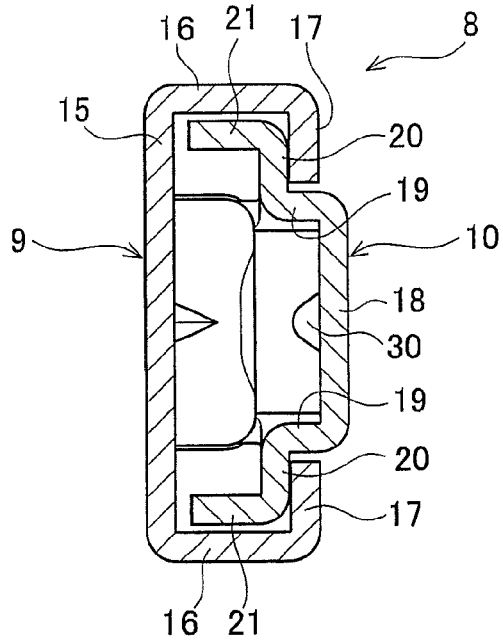
FIG. 4 is a cross-sectional view of the slide rail in the embodiment.

FIG. 4 is a cross-sectional view of the slide rail 8 taken along a line B-B in FIG. 3. The outer rail 9 in a position taken along the line B-B includes a bottom wall 15, side walls 16, and edge portions 17. The side walls 16 and the edge portions 17 are provided on both sides of the bottom wall 15 in a width direction (a direction perpendicular to the longitudinal direction). The side walls 16 and the edge portions 17 are made by bending an entirely flat plate including the bottom wall 15 by pressing. Two side walls 16 are formed by bending parts of the flat plate on the same side relative to the bottom wall 15. The edge portions 17 are formed by further bending respective upper end portions of the side walls 16 inwardly in the width direction so that a gap is provided between the edge portions 17. The aforementioned first stopper 13 is made by bending a part of the bottom wall 15 on the same side as the side walls 16.

The inner rail 10 is also made by bending a flat plate by pressing. The inner rail 10 taken along the line B-B includes a top face portion 18, first side walls 19, shelf-like portions (outer deck portions) 20, and second side walls 21. The first side walls 19 on both sides in the width direction are made by bending a part of the flat plate on the same side relative to the top face portion 18. Each shelf-like portion 20 is provided to extend outward in the width direction from an upper edge of the corresponding first side wall 19 and in parallel with the top face portion 18. Each second side wall 21 is formed to extend upward from an outer edge of the corresponding shelf-like portion 20. The second side walls 21 and the shelf-like portions 20 are covered by the side walls 16 and the edge portions 17 of the outer rail 9.

Each slide rail 8 consists of the outer rail 9 and the inner rail 10 in combination. As is clear from FIG. 4, the inner rail 10 is placed in the space of the outer rail 9 defined by the bottom wall 15, the side walls 16, and the edge portions 17. However, the top face portion 18 of the inner rail 10 is exposed to the outside through the gap between the edge portions 17. The side walls 16 and the edge portions 17 of the outer rail 9, particularly, the edge portions 17 serve to prevent the inner rail 10 from coming off the outer rail 9 to the right in FIG. 4.

Figure 5:
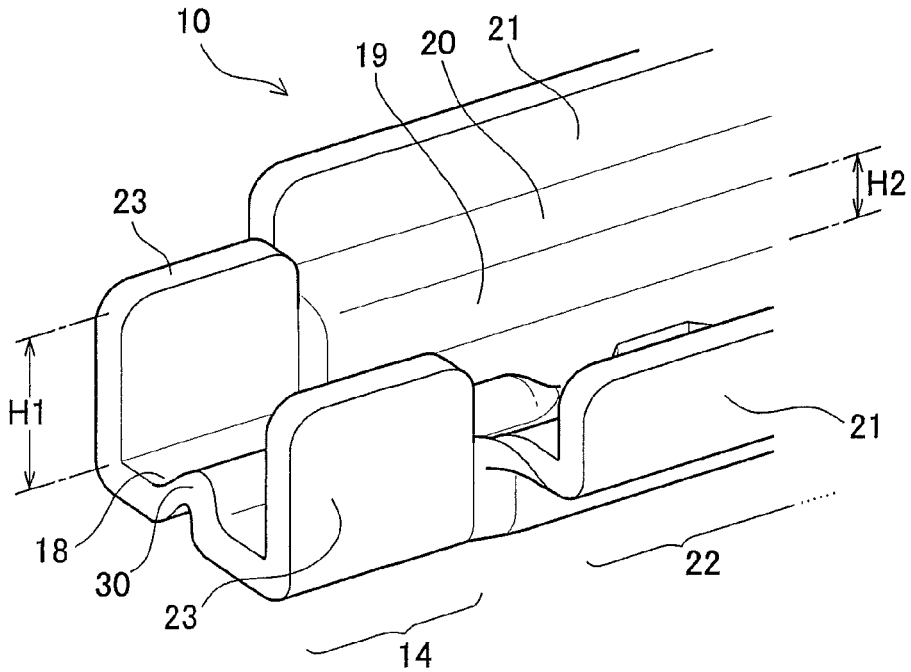
FIG. 5 is a perspective view (Part 1) of a first end portion of the inner rail of the slide rail and its surroundings in the embodiment.
Figure 6:
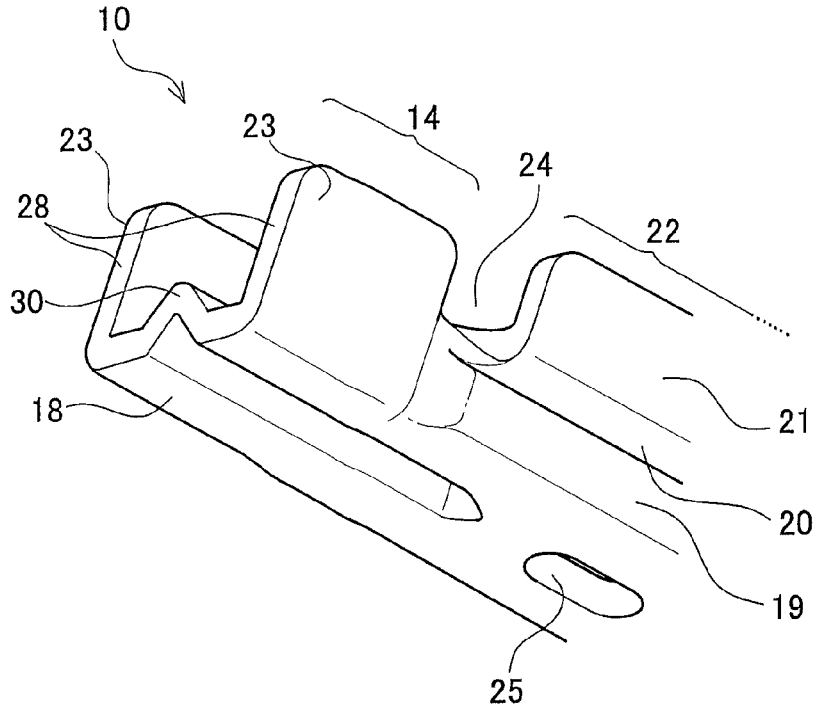
FIG. 6 is a perspective view (Part 2) of the first end portion of the inner rail of the slide rail and its surroundings in the embodiment.
Figure 7:
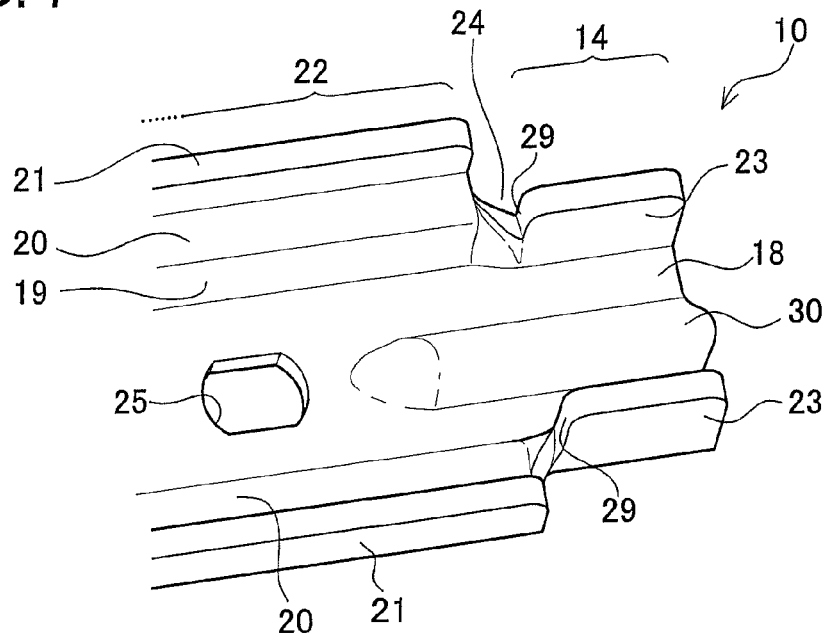
FIG. 7 is a perspective view (Part 3) of the first end portion of the inner rail of the slide rail and its surroundings in the embodiment.

The inner rail 10 is further explained below. FIGS. 5 to 7 show perspective views of the end portion 14 of the inner rail 10 in a separated state and its surroundings. The inner rail 10 includes the end portion 14 at one end and a main portion 22 other than the end portion 14. In the inner rail 10, the end portion 14 and the main portion 22 are different in shape. It is to be noted that an opposite end portion from the end portion 14 in the inner rail 10 is not particularly formed as a different shape from the main portion 22.

The end portion 14 of the inner rail 10 includes the top face portion 18 and end-portion side walls 23 arranged on both sides of the top face portion 18. The end-portion side walls 23 are made by bending parts of the flat plate at almost right angle with and on the same side of the top face portion 18. The top face portion 18 in the end portion 14 is formed with a bead 30. This bead 30 is a bent part of the top face portion 18, like a rib protruding toward the outer rail 9. The bead 30 is formed at the center in the width direction of the top face portion 18 and in parallel with the longitudinal direction of the inner rail 10. The bead 30 partially extends into the main portion 22. FIG. 4 is a cross-sectional view showing a part of the top face portion 18 not formed with the bead 30.

On the other hand, the main portion 22 of the inner rail 10 includes the top face portion 18, the first side walls 19, the shelf-like portions 20, and the second side walls 21, all of which are as mentioned above. The first side walls 19, the shelf-like portions 20, and the second side walls 21 are arranged on both sides of the top face portion 18. The top face portion 18 is continuous over the end portion 14 and the main portion 22. The end-portion side walls 23, the first side walls 19, the shelf-like portions 20, and the second side walls 21 are similarly made by bending parts of the flat plate on the same side of the top face portion 18. However, the first side walls 19, the shelf-like portions 20, and the second side walls 21 take a crank-like shape in cross-section as shown in FIG. 4.

Herein, relative to the top face portion 18, a protruding height H1 of the end-portion side wall 23 is larger than a protruding height H2 of each first side wall 19. Further, on each side of the top face portion 18, a slit 24 is formed between the end-portion side wall 23 and the shelf-like portion 20 and the second side wall 21, so that the slit 24 separates the end-portion side wall 23 from the shelf-like portion 20 and the second side wall portion 21. However, the slit 24 does not extend into the first side wall 19. Accordingly, the end-portion side wall 23 and the first side wall 19 are continuous to each other. End faces 28 (end faces on an upper left side in FIG. 6) of the end-portion side wall 23, opposite from the main portion 22, are contact surfaces that will contact the first stopper 13. On the other hand, end faces 29 (end faces on a left side in FIG. 7) of the end-portion side wall 23, facing to the main portion 22, are contact surfaces that will contact a second stopper 26 which will be mentioned later. A hole 25 formed in the top face portion 18 is used to fasten the unit tray 12 shown in FIG. 2 to the inner rail 10 with a screw.

Figure 8:
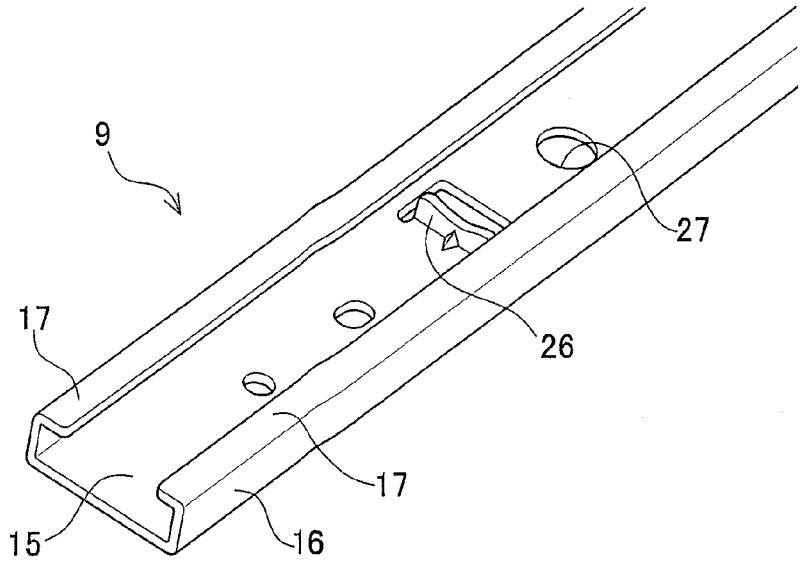
FIG. 8 is a perspective view (Part 1) of one end portion of an outer rail of the slide rail and its surroundings in the embodiment.
Figure 9:
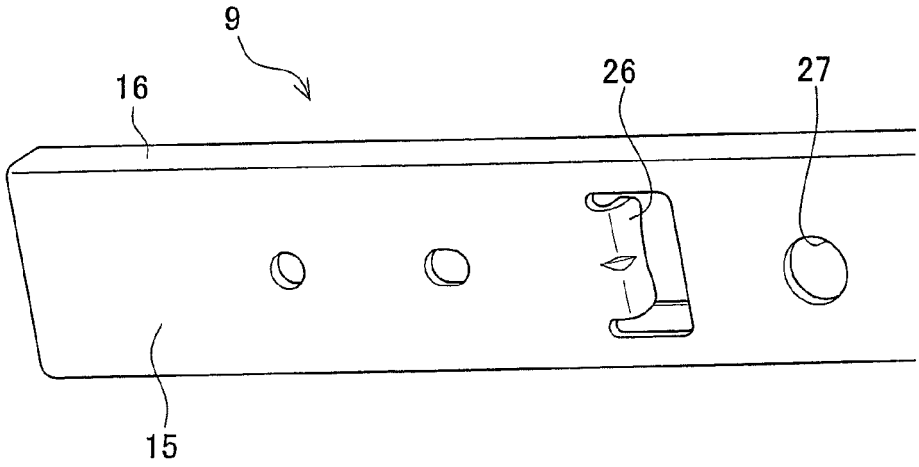
FIG. 9 is a perspective view (Part 2) of the one end portion of the outer rail of the slide rail and its surroundings in the embodiment.

The outer rail 9 will be explained below. FIGS. 8 and 9 show perspective views of one end portion of the outer rail 9 in a separated state and its surroundings. The outer rail 9 consists of, over its entire length, the bottom wall 15, the side walls 16, and the edge portions 17. The outer rail 9 does not include a specific portion like the end portion 14 of the inner rail 10, having a different configuration from other portions. However, as mentioned above, the first stopper 13 shown in FIG. 3 is formed in the other end portion of the outer rail 9. FIGS. 8 and 9 show the end portion and its surroundings opposite from the end portion with the first stopper 13.

On the other hand, the second stopper 26 is also illustrated in FIGS. 8 and 9. This second stopper 26 is made by bending a part of the bottom wall 15 on the same side as the side walls 16. The second stopper 26 is a portion to define one limit of the slidable range of the inner rail 10, thereby preventing the inner rail 10 from excessively moving left downward relative to the outer rail 9 in FIG. 2 and thus sliding out of the outer rail 9. A hole 27 formed in the bottom 15 serves to fasten the outer rail 9 to the mounting stay 11 shown in FIG. 2 with a screw.

The second stoppers 26, which are invisible because they are hidden behind the mounting stays 11 and others in FIG. 2, are located around positions indicated by arrows D. This position is just left below the position pointed out by the arrow A in FIG. 2. Specifically, in the slide rails 8 in FIG. 2, the inner rails 10 have been slid left-downward in FIG. 2 up to the limit of the slidable range relative to the outer rails 9. In other words, in this state, the end faces 29 of the end-portion side walls 23 of each inner rail 10 contact the second stopper 26. In this way, the first stoppers 13 and the second stoppers 26 restrict both limits of the slidable range of the inner rails 10.

The second stopper 26 in the slide rail 8 always face the first side walls 19 and the shelf-like portions 20 of the inner rail 10 but does not contact those portions. In other words, the second stopper 26 is designed to have a height to contact the end-portion side walls 23 but not to contact the first side walls 19 and others. Since the protruding height H1 of each end-portion side wall 23 is larger than the protruding height H2 of each first side wall 19, the height of the second stopper 26 can be set as above.

In each slide rail 8 configured as above in this embodiment, the inner rail 10 provides the following features. Specifically, the end-portion side walls 23 and the first side walls 19 are continuous to each other without being separated by the slits 24 formed between the end portion 14 and the main portion 22. The end portion 14 and the main portion 22 are continuous through not only the top face portion 18 but also the side walls (23 and 19). Accordingly, the end portion 14 is extremely high in strength as compared with a conventional slide rail in which an end portion and a main portion are continuous through only a top face portion. Further, the bead 30 formed in the top face portion 18 across the end portion 14 into the main portion 22 contributes to reinforcing the end portion 14. The end portion 14 is therefore less likely to be deformed even when the end portion 14 repeatedly bumps against the first stopper 13 and the second stopper 26. In short, the end portion 14 is high in durability.

Figure 10:
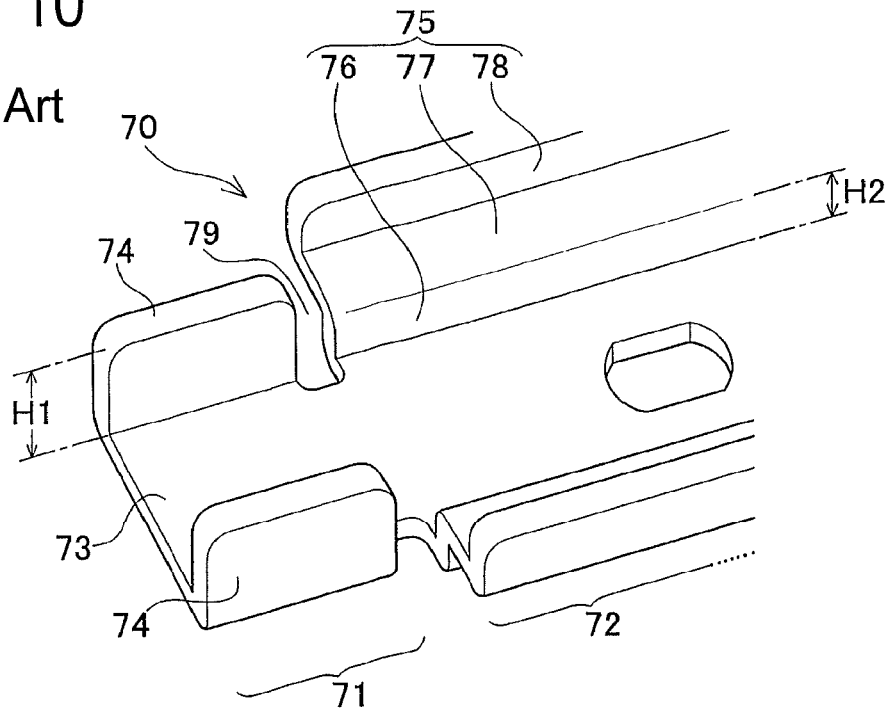
FIG. 10 Prior Art
FIG. 10 is a perspective view (Part 1) showing the shape of an end portion of an inner rail of a conventional slide rail.
Figure 11:
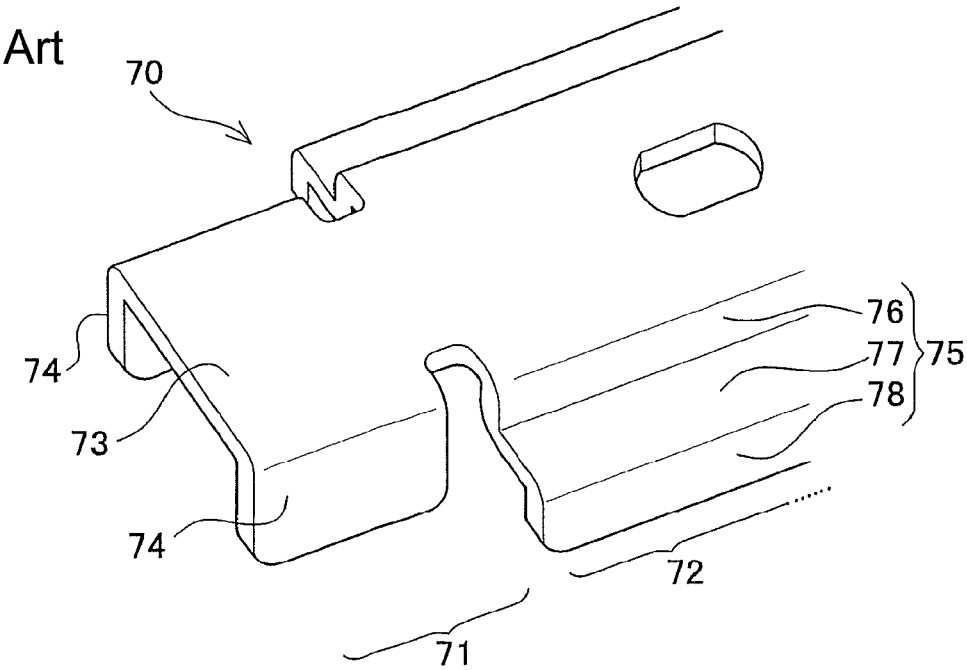
FIG. 11 Prior Art
FIG. 11 is a perspective view (Part 2) showing the shape of the end portion of the inner rail of the conventional slide rail.
Figure 12:
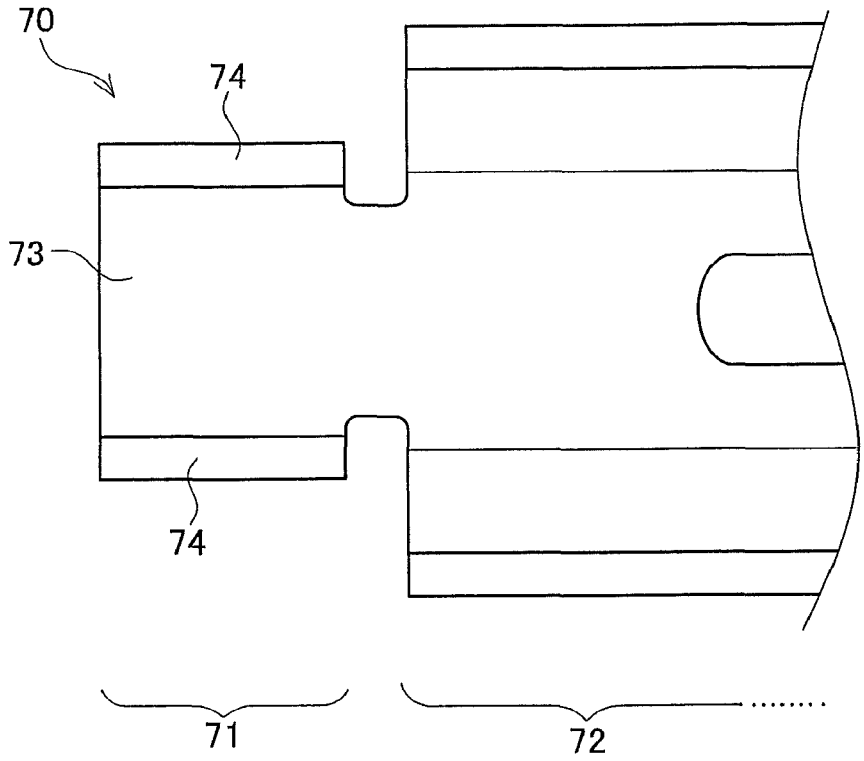
FIG. 12 Prior Art
FIG. 12 is a plan view showing the shape of the end portion of the inner rail of the conventional slide rail.

This is obvious from the comparison with the conventional slide rail. In the conventional slide rail 70 shown in FIGS. 10 to 12, the main portion 72 and the end portion 71 are continuous through only the flat portion 73. Thus, a connecting area between the main portion 72 and the end portion 71 is weak in strength. It is especially weak against impacts applied in a direction that separates the end portion 71 from the main portion 72. Such impacts are applied when the image forming unit is pulled out to a limit of the slidable range. In the present embodiment, to be concrete, this corresponds to the time when the end faces 29 of the end-portion side walls 23 contact the second stopper 26. In the conventional slide rail 70, therefore, the end portion 71 is liable to be deformed due to endurance use, resulting in loss of restricting function to the slidable range or loss of smoothness in sliding motion itself.

The slide rail 8 in the present embodiment does not cause such conventional problems. Since the end portion 14 is sufficiently high in strength as mentioned above, the end portion 14 is hardly deformed even when a pull-out operation and a push-back operation of the image forming unit 6K are conducted with a slam. Further, even when a user takes an unexpected operation, the slide rail 8 is vanishingly unlikely to be damaged and broken. The slide rail 8 in the present embodiment basically consists of only two components, i.e., the outer rail 9 and the inner rail 10. Thus, it is more simple in structure and lesser in the number of components as compared with a slide rail using a ball bearing and others. As above, the slide rail 8 having a simple structure and sufficient strength and the image forming apparatus 1 using the slide rail 8 are achieved.

The present embodiment is a mere example and does not impart any limitation to the present invention. The present invention may be embodied in other specific forms without departing from the essential characteristics thereof.

For instance, concrete shapes of the first side walls 19, the shelf-like portions 20, and the second side walls 21 of the inner rail 10 are not limited to the above. In particular, the second side walls 21 are not indispensable. The bead portion 30 does not necessarily have to be formed to extend into the main portion 22. As long as the bead portion 30 is formed in at least a part of the end portion 14, it can provide a reinforcing effect. It is however more preferable that the bead portion 30 extends into the main portion 22, thereby effectively reinforcing a connecting area between the main portion 22 and the end portion 14.

A distance between the first side walls 19 in the main portion 22 and a distance between the end-portion side walls 23 in the end portion 14 may be equal to or different from each other. If those distances are different, it is preferable that the distance between the end-portion side walls 23 is shorter than the distance between the first side wall portions 19. In this case, the first stopper 13 and the second stopper 26 are smaller than in a reverse case. The slit 24 may be formed to extend into, but partially, the first side wall 19. Specifically, the first side wall portion 19 and the end-portion side wall 23 have to be directly continuous at least partially.

As to the outer rail 9, similarly, concrete shapes of the side walls 16 and the edge portions 17 are not limited to the above. Any shape may be adopted only if it can prevent the inner rail 10 from sliding out of the outer rail 9 to the right in FIG. 4 and it does not interfere with sliding movement of the inner rail 10. For instance, a more complicated shape may be adopted according to the concrete shapes of the first side walls 19, the shelf-like portions 20, and the second side walls 21 in the inner rail 10. The first stopper 13 is not indispensable. For example, the first stopper 13 is not necessary if an entire structure of the image forming apparatus 1 is designed to prevent the inner rail 10 from protruding (sliding) right-downward in FIG. 3. Alternately, the first stopper 13 is not required in the structure allowing the inner rail 10 to protrude (slides) in such a manner.

It is also possible to reverse a relationship between the outer rail 9 and the inner rail 10 in the image forming apparatus 1. Specifically, the inner rails 10 may be fixed to the main body of the apparatus 1 and the image forming unit 6K may be mounted in the outer rails 9. The slide rails 8 may be applied to not only the image forming unit 6K but also any place in the image forming apparatus 1. Other image forming sections 6Y, 6M, and 6C may also be unitized respectively and the slide rails 8 may be applied to each unit. The image forming unit itself is not limited to one including a photo conductor and a developing device. A toner cartridge may be included. To the contrary, a photo conductor section and a developing device section may be separately unitized. The slide rails 8 also may be applied to a single toner cartridge and a sheet feed cassette. A configuration that mounts movable components with a single slide rail also may be adopted. Further, the image forming apparatus 1 itself may be a device having no reading section 5, a 4-cycle device, a monochrome machine, an instrument having a communication function with a public line, and others. Further, the present invention may be applied to various devices other than the image forming apparatus.

In the present invention, further preferably, a rib-like bent portion is formed in a portion of the top face portion adjacent to the end-portion side walls. This enhances the strength of the end portion, and hence provides excellent durability thereof. Accordingly, the end portion is less likely to be deformed.

In the present invention, it is preferable that the rib-like bent portion is formed in the top face portion to extend from an adjacent portion to the end-portion side walls to an adjacent portion to the main-portion side walls. Since the rib-like bent portion is formed in this manner, an area between the adjacent portion to the end-portion side walls and the adjacent portion to the main-portion side walls is effectively reinforced.

In the present invention, preferably, the outer rail includes the stopper portion provided in a part of the bottom wall, the stopper portion being configured to restrict one limit of the slidable range of the inner rail when the inner rail is slid relative to the outer rail and bump against the end faces of the end-portion side walls facing the main-portion side walls. In such configuration, the end faces of the end-portion side walls facing the main-portion side walls bump against the stopper portion, thereby imparting impacts to the inner rail. However, since the inner rail is reinforced as above, the inner rail exhibits sufficient resistance against impacts.

While the presently preferred embodiment of the present invention has been shown and described, it is to be understood that this disclosure is for the purpose of illustration and that various changes and modifications may be made without departing from the scope of the invention as set forth in the appended claims.

The present invention can provide a slide rail with less components and capable of achieving slidability and durability, and an image forming apparatus including the slide rail.

What is claimed is:

1. A slide rail comprising an outer rail and an inner rail, the inner rail being placed in the outer rail to be slidable in a longitudinal direction of the slide rail, wherein the inner rail comprises:

a top face portion located in a center of the inner rail in a width direction of the inner rail, the top face portion being continuous in the longitudinal direction;

main-portion side walls provided adjacently on both sides of the top face portion in a width direction in the width direction, excepting one end portion in the longitudinal direction, each main-portion side wall being bent toward the outer rail;

outer deck portions each extending outward in the width direction to be continuous to an edge of each main-portion side wall opposite the top face portion; and end-portion side walls provided adjacently on both sides of top face portion in the one end portion in the width direction, each end-portion side wall being bent toward the outer rail, a size in a height direction of each end-portion side wall is larger than a size in a height direction of each main-portion side wall, the end-portion side walls are directly continuous to the main-portion side walls respectively, and the outer rail comprises:

a bottom wall located in a center of the outer rail in a width direction of the outer rail, the bottom wall being continuous in the longitudinal direction; and storage portions provided adjacently on both sides of the bottom wall in the width direction, and each storage portion being bent toward the inner rail to cover the outer deck portions of the inner rail.

2. The slide rail according to claim 1, wherein the inner rail is formed with an elongated bent portion extending along the longitudinal direction, the bent portion being in a center of the top face portion adjacent to the end-portion side walls in the width direction.

3. The slide rail according to claim 2, wherein the elongated bent portion is formed to extend from a part of the top face portion adjacent to the end-portion side walls to another part of the top face portion adjacent to the main-portion side walls.

4. The slide rail according to claim 1, wherein the outer rail includes a stopper portion provided in a part of the bottom wall, the stopper portion being configured to limit one end of a slidable range of the inner rail by bumping against the end faces of the end-portion side walls facing the main-portion side walls when the inner rail is slid relative to the outer rail.

5. The slide rail according to claim 1, wherein the inner rail includes a slit formed between the end-portion side walls and the outer deck portions, the slit positioned to separate the end-portion side walls from the outer deck portions while not separating the end-portion side walls from the main-portion side walls.

6. An image forming apparatus comprising:

a main body;

an image forming unit configured to be slidable out of the main body;

a slide rail for mounting the image forming unit in the main body in a sliding manner, the slide rail comprises: an outer rail and an inner rail, the inner rail being placed in the outer rail to be slidable in a longitudinal direction of the slide rail, the inner rail comprises:

a top face portion located in a center of the inner rail in a width direction of the inner rail, the top face portion being continuous in the longitudinal direction;

main-portion side walls provided adjacently on both sides of the top face portion in a width direction in the width direction, excepting one end portion in the longitudinal direction, each main-portion side wall being bent toward the outer rail;

outer deck portions each extending outward in the width direction to be continuous to an edge of each main-portion side wall opposite the top face portion; and end-portion side walls provided adjacently on both sides of top face portion in the one end portion in the width direction, each end-portion side wall being bent toward the outer rail, a size in a height direction of each end-portion side wall is larger than a size in a height direction of each main-portion side wall, the end-portion side walls are directly continuous to the main-portion side walls respectively, and the outer rail comprises:

a bottom wall located in a center of the outer rail in a width direction of the outer rail, the bottom wall being continuous in the longitudinal direction; and storage portions provided adjacently on both sides of the bottom wall in the width direction, and each storage portion being bent toward the inner rail to cover the outer deck portions of the inner rail, and one of the inner rail and the outer rail is fixed to the main body and the other is fixed to the image forming unit.

7. The image forming apparatus according to claim 6, wherein the inner rail is formed with an elongated bent portion extending along the longitudinal direction, the bent portion being in a center of the top face portion adjacent to the end-portion side walls in the width direction.

8. The image forming apparatus according to claim 7, wherein the elongated bent portion is formed to extend from a part of the top face portion adjacent to the end-portion side walls to another part of the top face portion adjacent to the main-portion side walls.

9. The image forming apparatus according to claim 6, wherein the outer rail includes a stopper portion provided in a part of the bottom wall, the stopper portion being configured to limit one end of a slidable range of the inner rail by bumping against the end faces of the end-portion side walls facing the main-portion side walls when the inner rail is slid relative to the outer rail.

10. The image forming apparatus according to claim 6, wherein the inner rail includes a slit formed between the end-portion side walls and the outer deck portions, the slit positioned to separate the end-portion side walls from the outer deck portions while not separating the end-portion side walls from the main-portion side walls.

* * * * *